US012389939B2

(12) United States Patent
Wiedemann et al.

(10) Patent No.: US 12,389,939 B2
(45) **Date of Patent: *Aug. 19, 2025**

(54) PORTABLE PIPE ASSEMBLY

(71) Applicant: Puff Corporation, Los Angeles, CA (US)

(72) Inventors: Dane Wiedemann, Los Angeles, CA (US); Avinash Bajpai, Aguora Hills, CA (US); Roger Volodarsky, Glendale, CA (US)

(73) Assignee: Puff Corporation, Los Angeles, CA (US)

( * ) Notice: Subject to any disclaimer, the term of this patent is extended or adjusted under 35 U.S.C. 154(b) by 252 days.

This patent is subject to a terminal disclaimer.

(21) Appl. No.: 18/107,570

(22) Filed: Feb. 9, 2023

(65) Prior Publication Data

US 2023/0270160 A1 Aug. 31, 2023

Related U.S. Application Data

(63) Continuation of application No. 17/491,815, filed on Oct. 1, 2021, now Pat. No. 11,576,431.

(60) Provisional application No. 63/249,283, filed on Sep. 28, 2021.

(51) Int. Cl.

| | |
|---|---|
| ***A24F 1/30*** | (2006.01) |
| ***A24F 1/14*** | (2006.01) |
| ***A24F 5/10*** | (2006.01) |
| ***A24F 7/02*** | (2006.01) |

(52) U.S. Cl.

CPC ..... *A24F 1/30* (2013.01); *A24F 1/14* (2013.01); *A24F 5/10* (2013.01); *A24F 7/02* (2013.01)

(58) Field of Classification Search

CPC ..... A24F 9/16; A24F 1/30; A24F 1/14; A24F 5/10; A24F 7/02

See application file for complete search history.

(56) References Cited

U.S. PATENT DOCUMENTS

| | | | |
|---|---|---|---|
| D232,355 | S | 8/1974 | Wiedmann |
| 3,902,506 | A | 9/1975 | Hawie |
| D244,555 | S | 5/1977 | Wiedmann |
| D246,600 | S | 12/1977 | Kurata |
| D306,478 | S | 3/1990 | von Philipp |
| 4,960,206 | A | 10/1990 | Johannes |
| D413,172 | S | 8/1999 | Belschner |

(Continued)

FOREIGN PATENT DOCUMENTS

| | | |
|---|---|---|
| BR | DI6002906 | 3/2002 |
| CN | 303259701 | 6/2015 |

(Continued)

OTHER PUBLICATIONS

"Budsy," Apr. 1, 2021, Wayback Machine, https://web.archive.org/Aweb/20210401210427/https:/Avww.puffco.com/products/budsy (Year: 2021).*

(Continued)

*Primary Examiner* — Philip Y Louie
*Assistant Examiner* — Yana B Krinker
(74) *Attorney, Agent, or Firm* — Bryan Cave Leighton Paisner LLP

(57) ABSTRACT

The present invention relates to a portable water pipe assembly for use in the vaporization of substances. Methods of using such an assembly are also provided.

26 Claims, 18 Drawing Sheets

(56) References Cited

U.S. PATENT DOCUMENTS

| | | | |
|---|---|---|---|
| D427,691 | S | 7/2000 | Asselta |
| D445,493 | S | 7/2001 | Nystrom |
| D458,639 | S | 6/2002 | Anderson |
| D460,545 | S | 7/2002 | Hautmann |
| D465,031 | S | 10/2002 | Lodge |
| D470,235 | S | 2/2003 | Kumar |
| D508,458 | S | 8/2005 | Solland et al. |
| D536,434 | S | 2/2007 | DongSheng |
| D543,312 | S | 5/2007 | Guan |
| D553,122 | S | 10/2007 | Solland |
| D558,193 | S | 12/2007 | Ju |
| D581,035 | S | 11/2008 | Conway |
| D581,905 | S | 12/2008 | Solland |
| D588,687 | S | 3/2009 | Drucker |
| D597,191 | S | 7/2009 | Colombo |
| D605,303 | S | 12/2009 | Monks |
| D608,879 | S | 1/2010 | Colombo |
| D613,389 | S | 4/2010 | Jorgensen |
| D613,390 | S | 4/2010 | Jorgensen |
| D613,624 | S | 4/2010 | Bodum |
| D634,832 | S | 3/2011 | Abbondanzio |
| D652,571 | S | 1/2012 | Shenassa et al. |
| 8,179,245 | B2 | 5/2012 | Chander et al. |
| D661,827 | S | 6/2012 | Moetteli |
| 8,294,300 | B2 | 10/2012 | Cook et al. |
| D670,578 | S | 11/2012 | Perry |
| D674,892 | S | 1/2013 | Denton |
| D675,308 | S | 1/2013 | Freeborn |
| D702,090 | S | 4/2014 | Hogg |
| D706,212 | S | 6/2014 | Zwierstra et al. |
| D709,624 | S | 7/2014 | Baum |
| D713,100 | S | 9/2014 | Salgueiro |
| D720,064 | S | 12/2014 | Li |
| D724,264 | S | 3/2015 | Chambers |
| D724,779 | S | 3/2015 | Liu |
| D728,155 | S | 4/2015 | Liu |
| D728,382 | S | 5/2015 | Goswell |
| D752,278 | S | 3/2016 | Verleur |
| D752,279 | S | 3/2016 | Liu |
| D752,280 | S | 3/2016 | Verleur |
| D757,647 | S | 5/2016 | Engel |
| D757,996 | S | 5/2016 | Hua |
| D769,519 | S | 10/2016 | Chen |
| D772,478 | S | 11/2016 | Liu |
| D774,247 | S | 12/2016 | Chen |
| D778,460 | S | 2/2017 | Marechal |
| D789,374 | S | 6/2017 | King |
| D790,122 | S | 6/2017 | Hawes |
| 9,675,118 | B2 | 6/2017 | Chen |
| D792,645 | S | 7/2017 | Fornarelli |
| D796,433 | S | 9/2017 | Langhammer et al. |
| D800,383 | S | 10/2017 | Verleur |
| D801,545 | S | 10/2017 | Wiesli |
| D802,839 | S | 11/2017 | Scott |
| D806,941 | S | 1/2018 | Hawes |
| D809,190 | S | 1/2018 | Schuler |
| D810,015 | S | 2/2018 | Carreon et al. |
| D810,680 | S | 2/2018 | Carreon et al. |
| D811,931 | S | 3/2018 | Yu |
| D812,736 | S | 3/2018 | Parker |
| D813,448 | S | 3/2018 | Servutas |
| D814,103 | S | 3/2018 | Levinson |
| D818,638 | S | 5/2018 | Wright |
| D821,641 | S | 6/2018 | Watson |
| D823,534 | S | 7/2018 | Chen |
| D824,586 | S | 7/2018 | Fornarelli |
| D825,844 | S | 8/2018 | Verleur et al. |
| D827,149 | S | 8/2018 | Self |
| D827,152 | S | 8/2018 | Ou |
| D828,623 | S | 9/2018 | Fornarelli |
| D830,536 | S | 10/2018 | White |
| D833,030 | S | 11/2018 | Sasano |
| D837,999 | S | 1/2019 | Sasano |
| D839,446 | S | 1/2019 | Sasano |
| 10,211,658 | B2 | 2/2019 | Bonwit et al. |
| D844,441 | S | 4/2019 | DeMarco |
| D847,419 | S | 4/2019 | Hawes |
| D848,673 | S | 5/2019 | Xu |
| D849,318 | S | 5/2019 | Deng et al. |
| 10,321,714 | B1 | 6/2019 | Kane |
| D867,657 | S | 11/2019 | Fornarelli |
| D870,375 | S | 12/2019 | Patil |
| 10,517,334 | B1 | 12/2019 | Volodarsky et al. |
| D873,831 | S | 1/2020 | DePaolo et al. |
| D875,676 | S | 2/2020 | Segev |
| D892,043 | S | 8/2020 | Raghunathan |
| D897,282 | S | 9/2020 | Ye et al. |
| 10,813,386 | B1 | 10/2020 | Bajpai et al. |
| 11,000,067 | B1 | 5/2021 | Bajpai et al. |
| 2009/0013994 | A1 | 1/2009 | Jones et al. |
| 2009/0071481 | A1 | 3/2009 | Fishman |
| 2010/0104993 | A1 | 4/2010 | Ryser |
| 2013/0008442 | A1 | 1/2013 | Jones et al. |
| 2013/0319437 | A1 | 12/2013 | Liu |
| 2014/0083441 | A1 | 3/2014 | Kaplani |
| 2014/0102463 | A1* | 4/2014 | Jones ..... A61M 15/06 131/329 |
| 2014/0290677 | A1 | 10/2014 | Liu |
| 2015/0015182 | A1 | 1/2015 | Brandtman et al. |
| 2015/0122275 | A1 | 5/2015 | Wu |
| 2015/0165137 | A1 | 6/2015 | Mullinger et al. |
| 2015/0188339 | A1 | 7/2015 | Green et al. |
| 2015/0231341 | A1 | 8/2015 | Korneff |
| 2015/0257444 | A1 | 9/2015 | Chung |
| 2015/0320116 | A1 | 11/2015 | Bleloch |
| 2016/0007648 | A1 | 1/2016 | Sutton et al. |
| 2016/0015082 | A1 | 1/2016 | Liu |
| 2016/0219937 | A1 | 8/2016 | Rado |
| 2016/0295911 | A1 | 10/2016 | Kalousek et al. |
| 2016/0302486 | A1 | 10/2016 | Eroch |
| 2016/0366936 | A1 | 12/2016 | Liu |
| 2017/0027224 | A1 | 2/2017 | Volodarsky et al. |
| 2017/0027230 | A1 | 2/2017 | Fornarelli |
| 2017/0055579 | A1 | 3/2017 | Kuna |
| 2017/0055588 | A1 | 3/2017 | Cameron |
| 2017/0064994 | A1 | 3/2017 | Xu |
| 2017/0079324 | A1 | 3/2017 | Eksouzian |
| 2017/0105451 | A1 | 4/2017 | Fornarelli |
| 2017/0202265 | A1 | 7/2017 | Hawes et al. |
| 2017/0251718 | A1 | 9/2017 | Armoush |
| 2017/0295845 | A1 | 10/2017 | Bajpai et al. |
| 2018/0098569 | A1 | 4/2018 | Martin |
| 2018/0110941 | A1 | 4/2018 | Smith et al. |
| 2018/0125115 | A1 | 5/2018 | Mueller |
| 2018/0271150 | A1 | 9/2018 | Sparklin |
| 2019/0000138 | A1 | 1/2019 | Han |
| 2019/0014822 | A1 | 1/2019 | Bless et al. |
| 2019/0037921 | A1 | 2/2019 | Kennedy et al. |
| 2019/0089184 | A1 | 3/2019 | Mininger et al. |
| 2019/0109497 | A1 | 4/2019 | Yang et al. |
| 2019/0116884 | A1 | 4/2019 | Conley et al. |
| 2019/0159519 | A1 | 5/2019 | Bowen et al. |
| 2019/0174825 | A1 | 6/2019 | Neuhaus |
| 2019/0307171 | A1 | 10/2019 | Kane |
| 2019/0313692 | A1 | 10/2019 | Jones et al. |
| 2020/0031237 | A1 | 1/2020 | Colafrancesco et al. |
| 2020/0128882 | A1 | 4/2020 | Davis et al. |
| 2020/0183335 | A1 | 6/2020 | Mininger et al. |
| 2020/0221768 | A1 | 7/2020 | Volodarsky et al. |
| 2020/0236992 | A1* | 7/2020 | Ruiz ..... A24F 7/04 |
| 2020/0237004 | A1 | 7/2020 | Larsen |
| 2020/0352222 | A1 | 11/2020 | Larsen et al. |
| 2021/0045440 | A1 | 2/2021 | Volodarsky et al. |

FOREIGN PATENT DOCUMENTS

| | | |
|---|---|---|
| CN | 205285006 | 6/2016 |
| CN | 304205433 | 7/2017 |
| CN | 107529827 | 1/2018 |
| CN | 109275961 | 1/2019 |
| CN | 208798698 | 4/2019 |
| DE | 40010509 | 1/2001 |
| DE | 202014000343 | 4/2013 |
| DE | 102016012830 | 8/2017 |

(56) References Cited

FOREIGN PATENT DOCUMENTS

| | | |
|---|---|---|
| ES | D0518135 | 11/2013 |
| FR | 960094 | 5/1996 |
| MX | 22818 | 5/2007 |
| WO | 2020161570 | 8/2020 |
| WO | 2021041098 | 3/2021 |
| WO | 2022076230 | 4/2022 |
| WO | 2023055428 | 4/2023 |

OTHER PUBLICATIONS

Puffco Peak web page located at planetvape.ca 2019.
Puff Co., Peak Atomizer Assembly posted on Instagram retrieved from www.instagram.com/p/BfMk5MKIBp1/ Feb. 14, 2018.
Puff Co., Peak Video posted on Instagram retrieved from www.instagram.com/p/Bd-oaEkFrXC/ Jan. 15, 2018.
Puff Co. Glass Attachment Video posted on Instagram retreived from www.instagram.com/p/Bd3DfMRIWLo/ Jan. 12, 2018.
Puff Co., Puffco Peak Case posted on Instagram retrieved from www.instagram.com/p/Bd027vflYzM/ Jan. 11, 2018.
Puff Co., Puffco Peak Video posted on Instagram retrieved from www.instagram.com/p/BdtMs4qIHnH/ Jan. 8, 2018.
Puff Co., Puffco Peak Hero Shot posted on Instagram retrieved from www.instagram.com/p/BdybEMAI_zX/ Jan. 10, 2018.
Pax Labs, Inc., web page of vaporizers, retrieved from www.paxvapor.com Feb. 25, 2015.
Puffco Peak by Sneaky Pete Vaporizers, found online May 31, 2019, located at www.youtube.com/watch?v=7W7zX9LCxoQ Apr. 23, 2018.
Koerber, B., This weed company just made a smart bong and it's awesome, Mashable, located at mashable.com/2018/01/08/puffco-peak-smart-bong-dab-rig-concentrates/ Jan. 8, 2018.
Tarantola, A., The Puffco Peak vaporizer is a quick hit of concentrated genius, Engadget, located at www.engadget.com/2018/03/16/puffco-peak-vaporizer-hands-on/?guccounter=1 Mar. 18, 2018.
Puff Co., Reservations are now open for Peak Atomizer Assembly, retrieved from web.archive.org/web/20180224162936/https://www.puffco.com/ Feb. 24, 2018.
Engadget, Hands on Peak, retrieved from web.archive.org/web/20180330221034/https://www.engadget.com/2018/03/16/puffco-peak-vaporizer-hands-on/ Mar. 31, 2018.
Puff Co., Introducing the Peak, retrieved from vimeo.com/257080728 Feb. 28, 2018.
Dr. Dabbler, Vaporizers for sale, retrieved from https://web.archive.org/web/20170222202821/https://drdabbervaporizersforsale.weebly.com/ Feb. 22, 2017.
Dr. Dabbler, Boost: Black Edition retrieved from www.drdabber.com/products/boost-black-edition 2019.
Source Vapes, web page for Atomizers, retrieved from www.sourcevapes.com/collections/atomizers Feb. 16, 2016.
Vapexhale, Give the gift of relaxation, retrieved from www.xhl3.com Nov. 27, 2017.
Vapexhale, web page for starter kits, retrieved from www.xhl3.com 2019.
Cloud V Enterprises, Cloud V Bubbler Options, retrieved from cloudvapes.com/vaporizers/portable-enail/cloudv-electro-portable-dab-rig 2019.
Cloud V Enterprises, Ultra Slim Design Vaporizers, retrieved from cloudvapes.com/store/ Jan. 21, 2013.
Cloud V Enterprises, Cloud V, retrieved from cloudvapes.com/store/ Feb. 22, 2016.
Dabado Vaporizers, web page for Dabado Bolt, retrieved from dabadovaporizers.com/collections/bolts 2019.
Kevin H., Focusvape Tourist Review—The Accidental Tourist, retrieved from vapesterdam.com/review/focusvape-tourist-review/ 2019.
Focus Vape, web page of vaporizers, retrieved from focusvape.eu/shop/ Jul. 17, 2017.
Pax Labs, Inc., Pax 3, retrieved from paxvapor.com 2019.
Waxxim, Vape Pen Bubblers shopping page, retrieved from www.waxxim.com 2019.
Patent Cooperation Treaty, International Search Report for PCT/US2019/013501, 6 pages, Oct. 10, 2019.
Polar Bottle, Sport Cap, retrieved from polarbottle.com/product/bottles/free-replacement-cap/sport/ on Nov. 1, 2019 2019.
Lock & Lock, Lock & Lock, No BPA, Water Tight, Food Container, 2.5-cup, 20-oz, HPL933, retrieved from www.amazon.com/Water-Tight-Container-2-5-cup-HPL933/dp/B005BRGWZE on Nov. 1, 2019 Oct. 2014.
Smokea, Piecemaker Kahuna 2 in. Silicone Bong, retrieved from https://smokea.com/products/piecemaker-kahuna-2-silicone-bong?variant=37965420929 on Nov. 1, 2019 Jun. 2018.
Osprey, Hydraulics Bite Valve, retrieved from https://www.osprey.com/US/en/product/hydraulics-bite-valve-NONMAGVALV.html on Nov. 1, 2019 Apr. 2013.
Bray, Flowtek Triad Series, retrieved from www.bray.com/ball-valves/3-piece-valves/triad-series on Nov. 1, 2019 Mar. 2017.
SourceVape.ca, PuffcoPeak, retrieved from planetvape.ca/puffco-peak.html Nov. 21, 2019.
DHgate.com, SOC Enail Kit 2600mAh Capacity For Very Long Lasting And 4 Led Heat Settings VS Puffco The Lucid Lighting Peak, retrieved from dhgate.com/product/soc-enail-kit-2600mah-capacity-for-very-long/479400626.html Nov. 21, 2019.
Shenzhen Slinya Electronic Co Ltd., Crystal Qi Wireless Charging Pad For Iphone 6 6s Plus Samsung Galaxy S7 S6 / Nexus 6/ HTC 8X Smart Phone Wireless Charger, retrieved Nov. 30, 2020.
Kwmobile Store, Kwmobile Charging Station—5V 1.3A Charger With Micro USB Cable—Docking Station Compatible With IQOS 2.4/2.4 Plus Holder E-Cigarette, retrieved Nov. 30, 2020.
Otter Products, LLC OtterSpot Wireless Charging System, retrieved from bit.ly/3r1rvLf 2020.
Mophie Powerstation Wireless—External Battery Charger for Qi Enabled Devices (10,000mAh)—Black, retrieved from www.amazon.com/dp/B01JCIJ2PO?tag=androidcentralb-20&ascsubtag=UUacUdUnU73790YYwYg 2020.
MOMA Design Store, Lexon Oblio Wireless Charging Station & UV Sanitizer, retrieved from store.moma.org/tech/featured/lexon-pop-up/lexon-oblio-wireless-charging-station-uv-sanitizer/11451.html 2020.
Phonesoap, PhoneSoap Go, retrieved from www.phonesoap.com/products/phonesoap-go 2020.
Nomad Goods, Inc., Nomad Charging Hub 5 Port Edition, retrieved from www.amazon.com/Nomad-charging-Powers-devices-indicators/dp/B075747DM4 2020.
Spansive, Spansive Source Multi Device Wireless Charging Station—Compatible with iPhone 11 Pro Max 11 Pro 11 Xs Max XR Xs X 8 8 Plus (White), retrieved from www.amazon.com/Spansive-Source-Device-Wireless-Charger/dp/B07YXCVRJ9 2020.
Patent Cooperation Treaty, International Search Report for PCT/US2020/046904, 3 pages Jan. 15, 2021.
Grenco Science, Gpen Connect Collection, retrieved from web.archive.org/web/20191001142752/https://www.gpen.com/collections/g-pen-connect Oct. 1, 2019.
EPuffer, Inc., ePuffer ePipe, retrieved from epuffer.com/news-and-press/epuffer-epipe-629x-flat-led-cap/ Apr. 4, 2020.
Dr. Dabbler, Boost: Black Edition Support retrieved from web.archive.org/web/20210127091740/https://www.drdabber.com/pages/boost-black-support Jan. 27, 2021.
Vapeyaya, e-pipe, retrieved from web.archive.org/web/20210509224114/https://www.vapeyaya.com/index.php?_route _=Premium-E-cig-E-Pipe May 9, 2021.
Pulsar Vaporizers, Pulsar Petite Pocket Carting Rig Bubbler, retrieved web.archive.org/web/20210331144200/https://www.pulsarvaporizers.com/products/pulsar-petite-pocket-cart-rig-bubbler-5 from Mar. 31, 2021.
Lookah, Lookah Q7 Mini Enail Banger Fits onto Water Pipes and Dab Rigs, retrieved from web.archive.org/web/20210124114528/https://www.lookah.com/vaporizers/dab-vaporizer/lookah-q7-water-pipe-compatible-concentrate-vaporizer.html Jan. 24, 2021.
Smokeheir, Waterpipe, retrieved from smokeheir.com/product/waterpipe-13-silver-edition-2/ 2021.

(56) References Cited

OTHER PUBLICATIONS

Waxmaid, Waxmaid 8" Universal Traveler Water Bottle Pipe, retrieved from https://www.waxmaidstore.com/products/waxmaid-8-universal-traveler-water-bottle-pipe/ 2021.
Hydro Flask, Wide Mouth Straw Lid, retrieved from www.hydroflask.com/wide-mouth-straw-lid?color=black 2021.
Puff Corporation, Puffco Travel Glass, retrieved from www.puffco.com/products/puffco-travel-glass 2021.
Headway, Headway Replacement Metal Pull Slide, retrieved from smokea.com/products/headway-replacement-metal-pull-slide 2021.
Bong Outlet, Glass bowl with round handle, retrieved from www.bongoutlet.com/products/glass-bowl-with-round-handle 2021.
Dhgate, Two layers Siliclab design silicone water bong collapsible water cup drinking smoking together glass bubbler pipes heady dab rig, retrieved from www.dhgate.com/product/two-layers-siliclab-design-silicone-water/476693529.html 2021.
VOLCANEE002 Instragram handle; Glass supplier, Instagram demo, retrieved from www.instagram.com/p/CUGyByBgFjp/?utm_medium=copy_link 2021.
Patent Cooperation Treaty, International Search Report for PCT/US2021/052758, 5 pages Feb. 9, 2022.
Waxmaid Bong Bottle Traveler Mouthpiece Reviewing Video posted on YouTube by Waxmaid on Sep. 29, 2019 Sep. 29, 2019.
Puffco Budsy Review: Meet the Smokeable Water Bottle retrieved from https://herb.co/guides/puffco-budsy-review/ on Dec. 1, 2021 (review article published online on Oct. 26, 2021) Oct. 26, 2021.
Amazon.com: Hydro Flask Wide Mouth Insulated Sports Water Bottle Straw Lid retrieved from https://www.amazon.com/Hydro-Flask-Insulated-Sports-Bottle/dp/B01GW2HF98 on Nov. 10, 2021 Nov. 10, 2021.
Malachosky, "Heir's Understated, Ultra-Premium Waterpipe" retrieved from https://coolhunting.com/buy/matcha-green-tea-movement-bundle/ on Nov. 30, 2021 (review article published online on Mar. 2, 2021) Mar. 2, 2021.
Puffco—Budsy retrieved from https://www.puffco.com/products/budsy?variant=39699376799803 on Nov. 10, 2021 Nov. 10, 2021.
Grasscity Solid Colored Glass Bowl with Handle, retreived from https://www.grasscity.com/solid-colored-glass-bowl-with-handle-male-joint.html?ref=weedrepublic on Nov. 30, 2021 (product review posted as early as Jan. 6, 2021) Nov. 30, 2021.
Budsy Demo photo posted by Puffco (posted on Apr. 1, 2021) Apr. 1, 2021.
Cheech & Chong Ceramic 2 in 1 Combo Pipe Mug Coffee Mug Coffee Cup, retrieved from www.ebay.com. Last updated on Sep. 9, 2021 Sep. 9, 2021.
Custom Accessories 93365D Black Smokeless Ashtray,0.3, retrieved from www.amazon.com. Date First Available Aug. 17, 2005 Aug. 17, 2005.
There's Now a Telescoping Coffee Mug That Extends Out To Become a Bong, retrieved from https://odditymall.com/telescoping-coffee-mug-bong. Dated Apr. 20, 2020 Apr. 20, 2020.
Patent Cooperation Treaty, International Search Report for PCT/US2022/022129, 3 pages Jul. 21, 2022.

* cited by examiner

PORTABLE PIPE ASSEMBLY

CROSS-REFERENCE TO RELATED APPLICATIONS

This application is a continuation of U.S. application Ser. No. 17/491,815, filed Oct. 1, 2021, which claims priority to U.S. provisional application No. 63/249,283 filed on Sep. 28, 2021, the entire content of which is hereby incorporated by reference herein in its entirety.

FIELD OF THE INVENTION

Aspects of the present invention relate to portable water pipe assemblies for inhalation of a gas entrained with product and methods of using.

BACKGROUND

A water pipe is an inhalation device generally used for smoking herbal substances such as tobacco or cannabis. The use of water pipes can date back to over 2,000 years ago, and it has various designs around the world. A water pipe can be made of various materials such as, e.g., glass, plastic, metal, bamboo, etc., which can withstand repeated use and heat exposure without breaking. When smoking through a water pipe, the gas entrained with product of the burned herbal substance passes through the water before being inhaled by the smoker. It is believed that the water can trap some heavier particles and water-soluble molecules, preventing them from entering the smoker's airways, and may also provide a cooling effect.

Studies have shown that water-filtered smoke is less harmful than non-filtered smoke. For example, it was found that when alveolar macrophages (mononuclear phagocytes found in the alveoli of the lungs, which ingest small inhaled particles resulting in the degradation, clearance and presentation of the antigen to adaptive immune cells) were exposed to unfiltered smoke, their ability to fight bacteria was reduced, unlike exposure to water-filtered smoke. There is also substantial epidemiological evidence of a lower incidence of carcinoma among tobacco smokers who used water pipes, as opposed to cigarettes, cigars and other unfiltered devices. In the case of cannabis smoking, it is believed that water filtration can be effective in removing components from cannabis smoke that are known as toxic, and the effectiveness of toxic substance removal may be related to the smoke's water contact area. One way to increase the smoke's water contact areas is to break up the smoke into very fine bubbles. This can be achieved by, e.g., incorporating particulate filters and gas dispersion frits into the water pipes.

Accordingly, there is a need for a portable water pipe that provide an enhanced smoking experience, including improved quality of inhalation and improved ease of use, in a discrete. Aspects of the present disclosure are intended to address such issues.

SUMMARY

Aspects of the invention are directed to a water pipe assembly for inhalation of a gas entrained with product. The water pipe assembly comprises: a container for receiving water therein, a removable bowl for receiving the product, an upper cap piece adapted to fit over the upper opening of the container housing, and a gas flow tube configured to extend from the upper cap piece into the interior region of the container. The container has a housing about an interior region and comprises an upper opening. The removable bowl comprises a bowl body comprising a top opening and having one or more apertures in a bottom portion thereof to allow the gas entrained with the product to pass therethrough, and the removable bowl comprises a handle extending laterally from the bowl body and has a sealing portion. The upper cap piece comprises: a cap body comprising a compartment having first and second bowl receiving regions, the first bowl receiving region comprising a first recess configured to receive the bowl body, and the second bowl receiving region comprising an outlet that passes through the cap body, and over which the removable bowl can be positioned to provide a flow of the gas entrained with product from the apertures in the bowl body to the outlet during operation of the water pipe assembly; and a mouthpiece attached to the cap body, and having an inhalation outlet for inhaling the gas entrained with product, the mouthpiece being configured to transition between a closed position covering the compartment, to an open position that allows access to the compartment. The gas flow tube is configured to receive the flow of gas entrained with the product from the removable bowl via the outlet to introduce the flow of gas entrained with the product into the interior region of the container. The removable bowl is configured such that (i) the bowl body is received in the second bowl receiving region so as to provide the flow of gas entrained with the product to the gas flow tube during operation of the water pipe assembly, when the mouthpiece is in the open state, and (ii) the bowl body is received in the first recess of the first bowl receiving region and is covered by the mouthpiece when the mouthpiece is in the closed state, and the removable bowl is also configured such that the sealing portion of the handle extends over and seals off the outlet in the second bowl receiving region, when the bowl body is received in the first recess of the first bowl receiving region.

According to another aspect of the invention, a method of using the water pipe assembly disclosed herein is also provided. This method comprises: removing the upper cap piece from the container housing and filling the interior region of the container with water to a predetermined level; re-attaching the upper cap piece to the container housing, such that a lower end of the gas flow tube is submerged in the water in the interior region of the container; transitioning the mouthpiece to the open position to reveal the compartment having the first and second bowl receiving regions; inserting the removable bowl into the second bowl receiving region of the upper cap piece; filling the bowl body of the removable bowl with product; igniting the product in the bowl body, thereby forming the flow of gas entrained with the product that passes into the water in the interior region of the compartment and on to the mouthpiece; and inhaling the flow of gas entrained with the product received from the interior region of the compartment via the inhalation outlet of the mouthpiece.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DETAILED DESCRIPTION OF THE INVENTION

Aspects of the invention as described herein are directed to an improved, low profile, portable water pipe assembly for the inhalation of substances, such as aromatic substances, therapeutic substances and/or substances with physiological effects. Examples of such substances can include herbs, such as tobacco, cannabis, lavender, chamomile, and other types of plant material. In an embodiment, the water pipe assembly disclosed herein uses a product selected from tobacco leaves, cannabis flowers, or other herbal substances.

Figure 1:
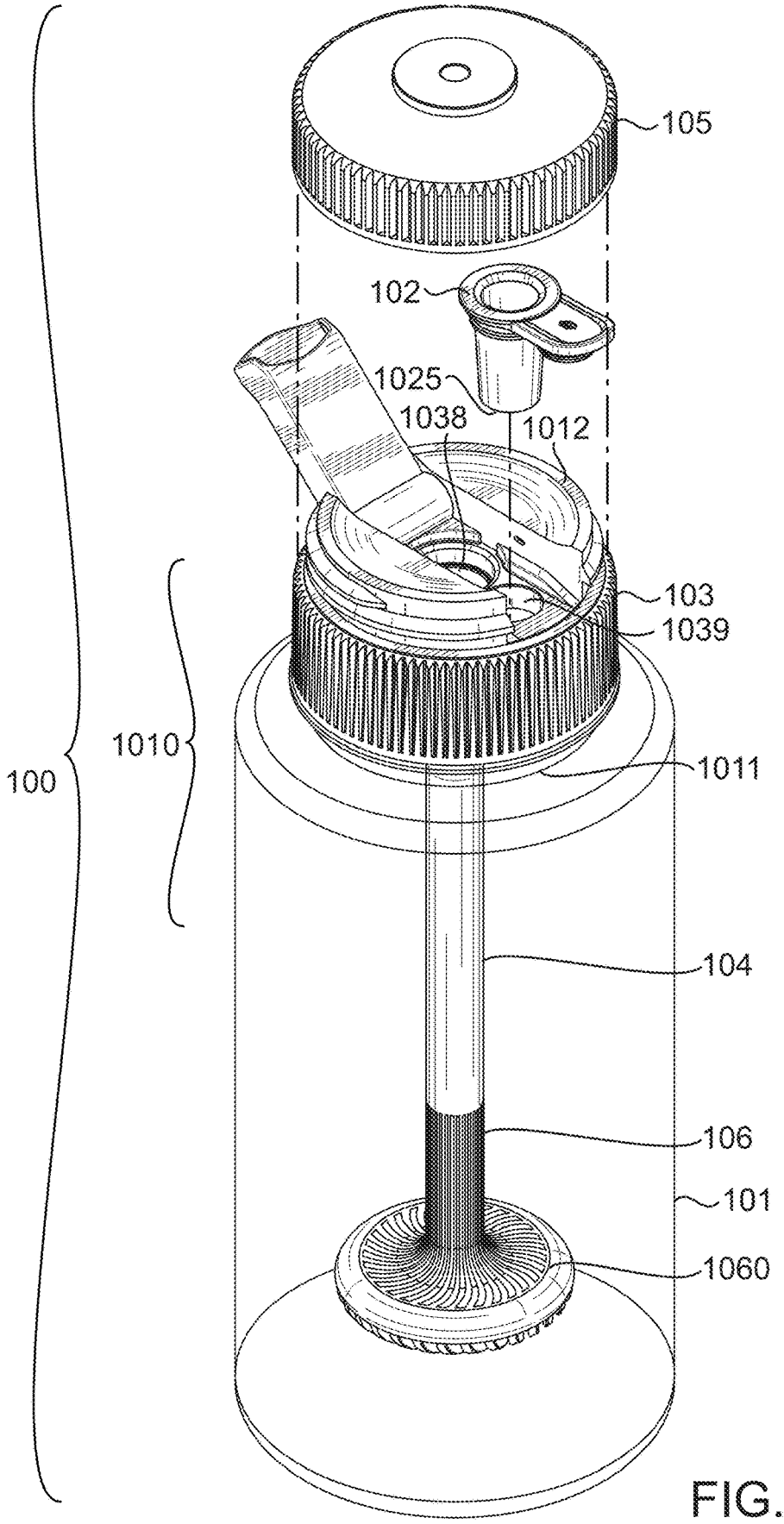
FIG. 1 shows an exploded view of an embodiment of a portable water pipe assembly.
Figure 2:
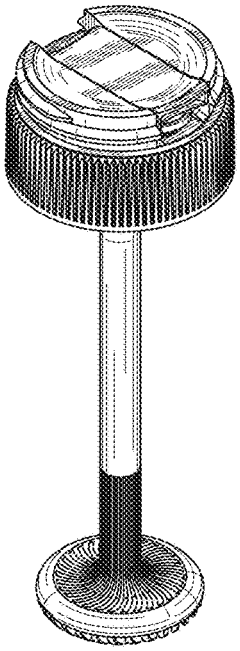
FIG. 2 is a perspective view of a representative assembled structure of the upper cap piece, the gas flow tube and the bubbler assembly, in the closed state.
Figure 3:
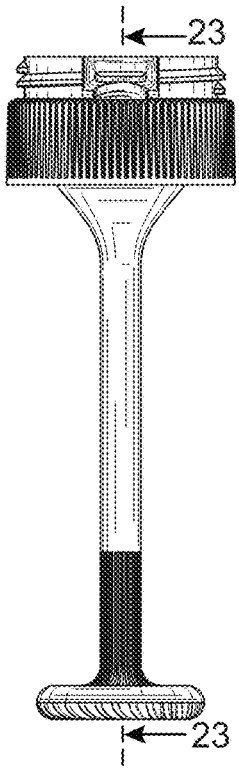
FIGS. 3-6 are side views of the structure of FIG. 2.
Figure 4:
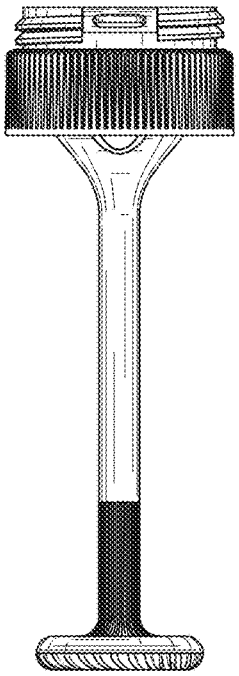
Figure 5:
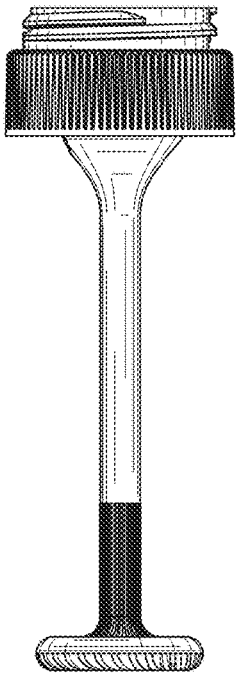
Figure 6:
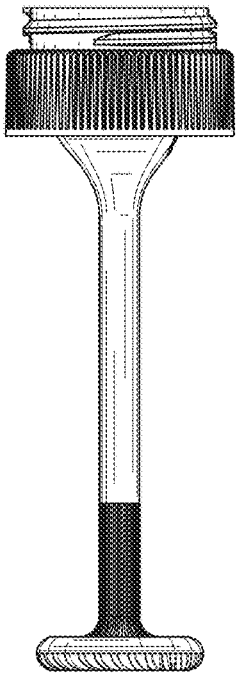
Figure 7:
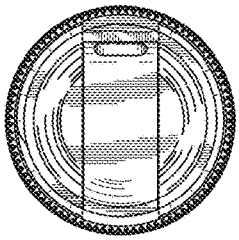
FIG. 7 is a top view of the structure of FIG. 2.
Figure 8:
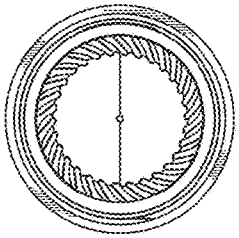
FIG. 8 is a bottom view of the structure of FIG. 2.
Figure 9:
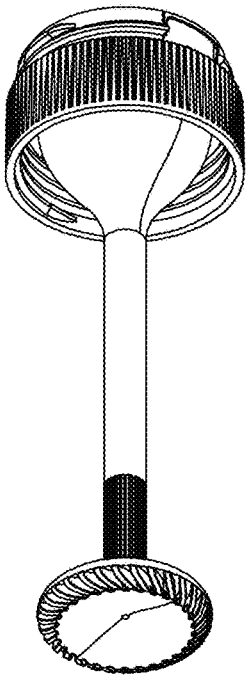
FIG. 9 is a perspective view of the structure of FIG. 2 from a different angle.
Figure 10:
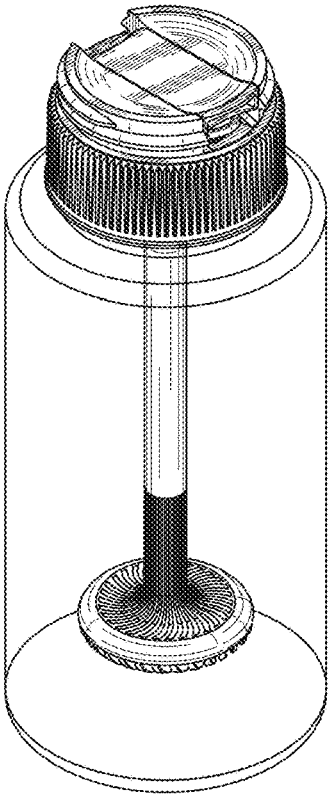
FIG. 10 is a perspective view of the portable water pipe assembly in its closed state excluding the cap.
Figure 11:
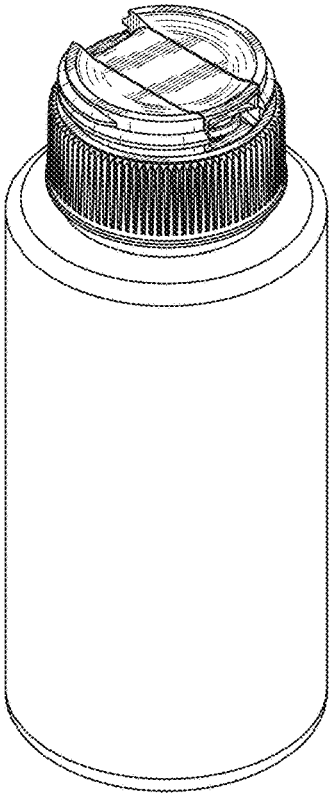
FIG. 11 is another perspective view of the assembly of FIG. 10 not showing the interior structure.
Figure 12:
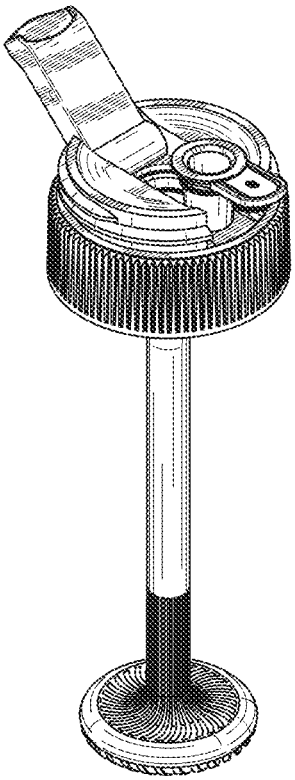
FIG. 12 shows the open state of the structure of FIG. 2.
Figure 13:
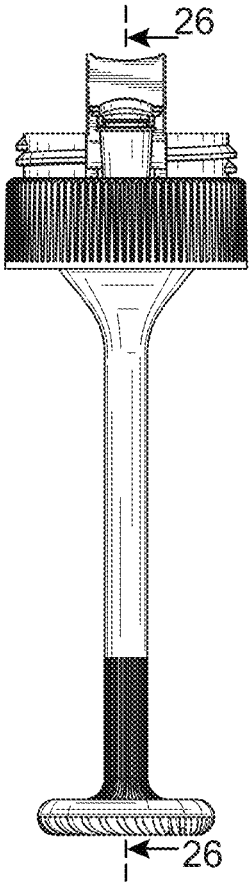
FIGS. 13-16 are side views of the structure of FIG. 12.
Figure 14:
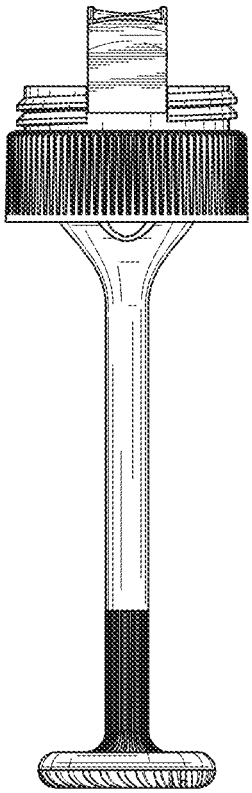
Figure 15:
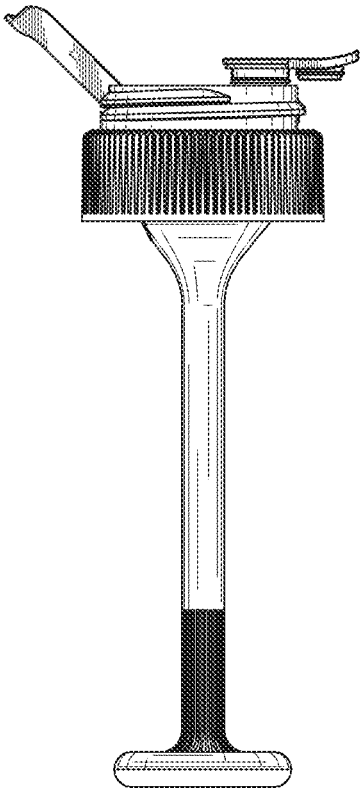
Figure 16:
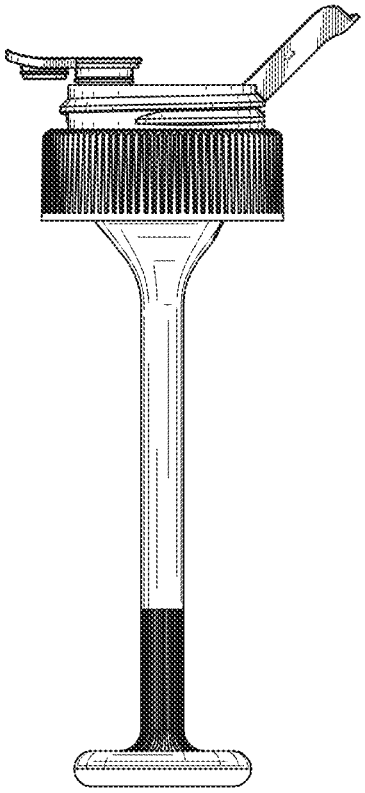
Figure 17:
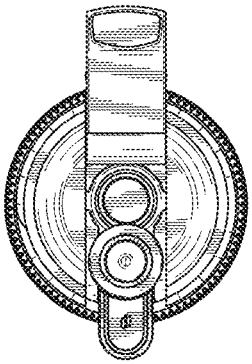
FIG. 17 is a top view of the structure of FIG. 12.
Figure 18:
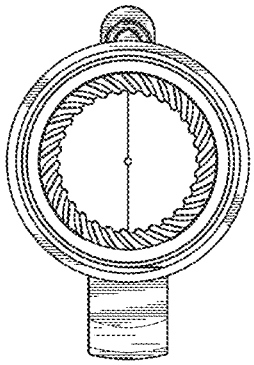
FIG. 18 is a bottom view of the structure of FIG. 12.
Figure 19:
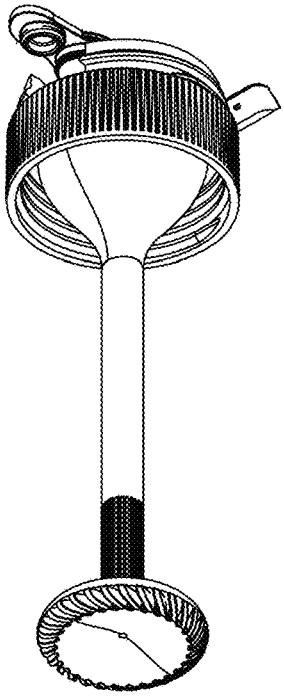
FIGS. 19 and 20 are perspective views of the structure of FIG. 12 from different angles.
Figure 20:
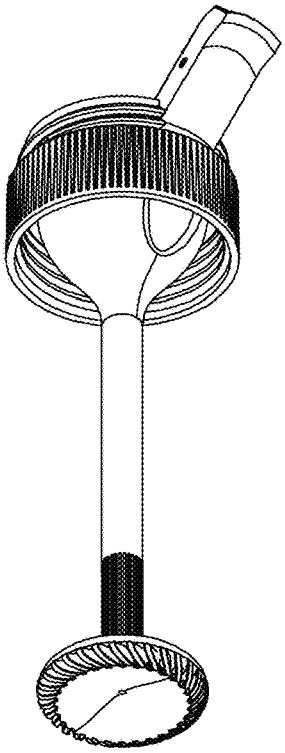
Figure 21:
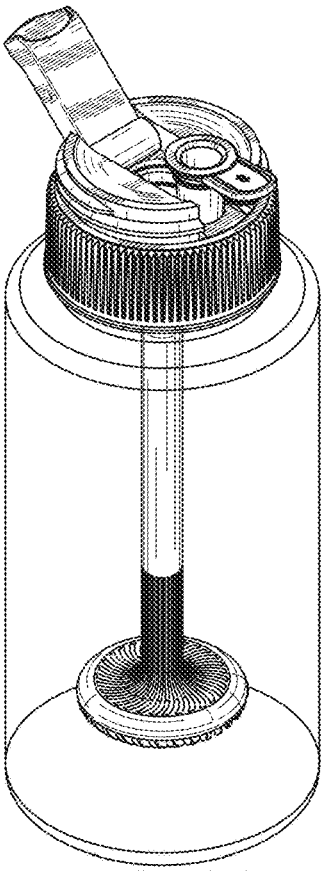
FIG. 21 shows the open state of the portable water pipe assembly of FIG. 10.
Figure 22:
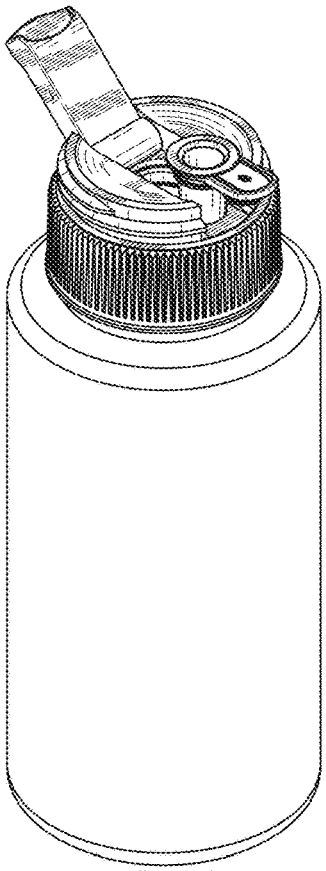
FIG. 22 shows the open state of the portable water pipe assembly of FIG. 11.

Referring to FIG. 1, an embodiment of a portable water pipe assembly 100 is shown in exploded view, according to aspects of the disclosure herein. The portable water pipe assembly 100 comprises a container 101 for receiving water therein, a removable bowl 102 for receiving the product, an upper cap piece 103 adapted to fit over the upper opening 1011 of the container housing, and a gas flow tube 104 configured to extend from the upper cap piece into the interior region of the container 101. In an embodiment, the container 101 is transparent or translucent and made of food-grade material. In some embodiments, the food-grade material is BPA free such as, e.g., Tritan™.

In an embodiment, the upper cap piece 103 comprises a threaded portion 1037 to attach to a complementary threaded portion 1012 at a top region 1010 of the container 101. In another embodiment, the portable water pipe assembly 100 may further comprise a removable cap top 105 that is configured to be fitted over the cap body when the water pipe assembly 100 is in the closed state. The removable cap top 105 may fit over the cap body via various means, such as, e.g., a threaded design or a clip.

In an embodiment, the portable water pipe assembly can further comprise a bubbler assembly 106 attached to the end of the gas flow tube 104 extending into the interior region of the container. In some embodiments, the bubbler assembly 106 may comprise a plurality of bubbler apertures configured to introduce the flow of gas entrained with the product received from the gas flow tube 104 into the interior region of the container 101. In some embodiments, the bubbler assembly 106 comprises a disc 1060 attached at a lower end of the gas flow tube 104, the disc comprising a plurality of bubble apertures formed on an underside thereof and at a plurality of regions about the circumference of the disc. In some other embodiments, the bubbler assembly 106 that is configured to diverge the flow of gas entrained with the product that is received from the removable bowl 102 into a plurality of airflows, to increase the contact area of the flow of gas entrained with the product with a liquid filled in the interior region of the container 101. A higher effectiveness of toxic substance removal is expected using the above designs.

Figure 23:
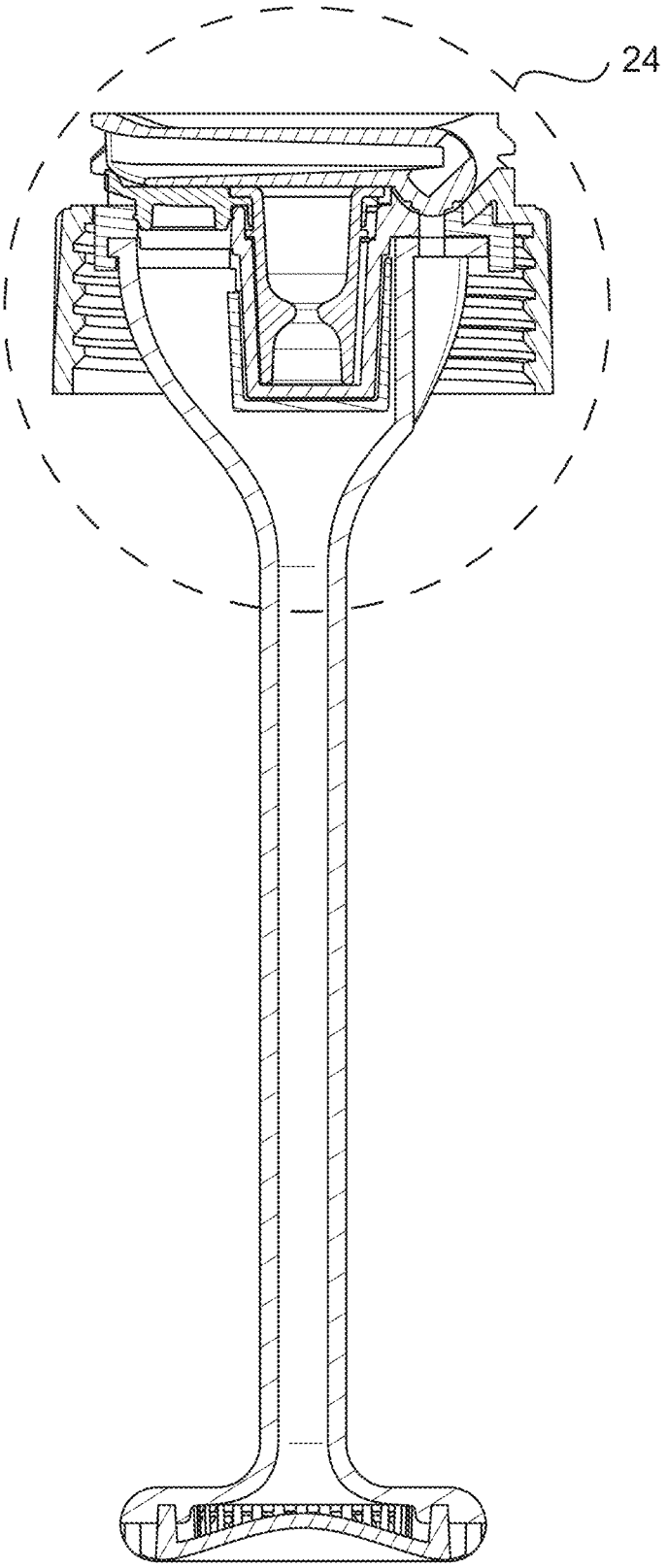
FIG. 23 is a cross-sectional view of the structure of FIG. 3.

Referring to FIG. 23, an embodiment of the portable water pipe assembly 100 in closed state is shown. Further referring to FIG. 24, in which the removable bowl 102 and the upper cap piece 103 are shown in detail. The upper cap piece 103 comprises a cap body 1030 comprising a compartment 10301 having first and second bowl receiving regions 1031 and 1032, the first bowl receiving region 1031 comprising a first recess 1038 configured to receive the bowl body 102, and the second bowl receiving region 1032 comprising an outlet 1033 that passes through the cap body 1030. A mouthpiece 1034 is attached to the cap body 1030, and has an inhalation outlet 1035 for inhaling the gas entrained with product. The removable bowl 102 comprises a bowl body 1020 comprising a top opening 1021 and having one or more apertures 1022 in a bottom portion 1025 thereof to allow the gas entrained with the product to pass therethrough, and the removable bowl 102 comprises a handle 1023 extending laterally from the bowl body 1020 and has a sealing portion 1024. In an embodiment, the bowl body 1020 of the removable bowl 102 is made of heat resistant materials like, e.g., ceramic, and the handle 1023 (including the sealing portion 1024) comprises a silicone sealing material.

Figure 24:
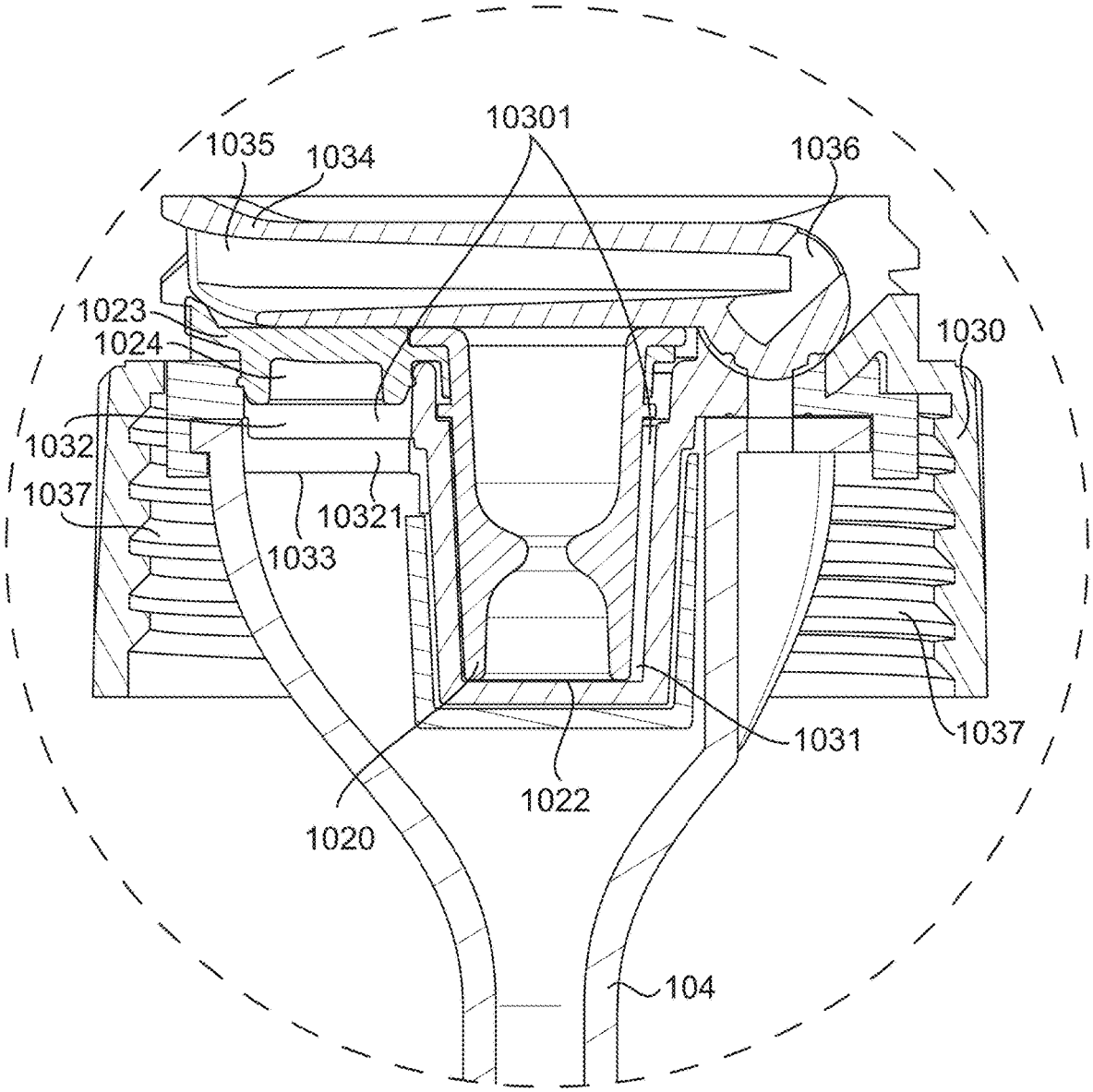
FIG. 24 is a cross-sectional view of the upper portion of the structure of FIG. 3.

In another embodiment, the one or more apertures 1022 in the bottom portion of the bowl body 1020 are sized to allow air flow thereinthrough while also substantially maintaining the product contained in the bowl body 1020. In the closed state as shown in FIGS. 23 and 24, the bowl body 1020 is received in the first recess of the first bowl receiving region 1031 and is covered by the mouthpiece 1035, and the sealing portion 1024 of the handle 1023 extends over and seals off the outlet 1033 in the second bowl receiving region 1032.

In an embodiment, the sealing portion 1024 of the handle 1023 comprises a sealing projection that extends from an underside of the handle 1023 and is configured to be fitted over the outlet 1033 of the second bowl receiving region 1032 when the mouthpiece 1034 is in the closed state.

In another embodiment, the first and second bowl receiving regions 1031, 1032 are located adjacent to one another in the compartment, such that the sealing portion 1024 of the handle 1023 is capable of extending over and sealing off the outlet 1033 in the second bowl receiving region 1032 when the bowl body 1020 is received in the first receiving region 1031. In further embodiment, the first recess of the first bowl receiving region 1031 is configured to accommodate a major portion of the bowl body 1020 within the first recess when the bowl body 1020 is received in the first bowl receiving region 1031, and the first recess is configured to allow the handle 1023 of the removable bowl 102 to extend laterally from a top of the recess and over the outlet 1033 of the second receiving region 1032 to seal the outlet 1033.

In an embodiment, the second bowl receiving region 1032 comprises a second recess 1039 that is adjacent to the first recess of the first bowl receiving region 1031, the second recess being separated from the first recess by a distance substantially equivalent to a reach of the handle 1023 from the first receiving region to the outlet 1033 of the second receiving region 1032, when the bowl body 1020 is received in the first receiving region 1031. In another embodiment, the second bowl receiving region 1032 comprises a second recess having the outlet 1033 therein and configured to receive the bowl body 1020, and wherein the sealing portion 1024 of the handle 1023 of the removable bowl 102 extends into the second recess to plug the second recess and outlet 1033.

In yet another embodiment, the mouthpiece 1034 substantially conceals the compartment having the first and second bowl receiving regions 1031, 1032, when the mouthpiece 1034 is in the closed state.

Figure 26:
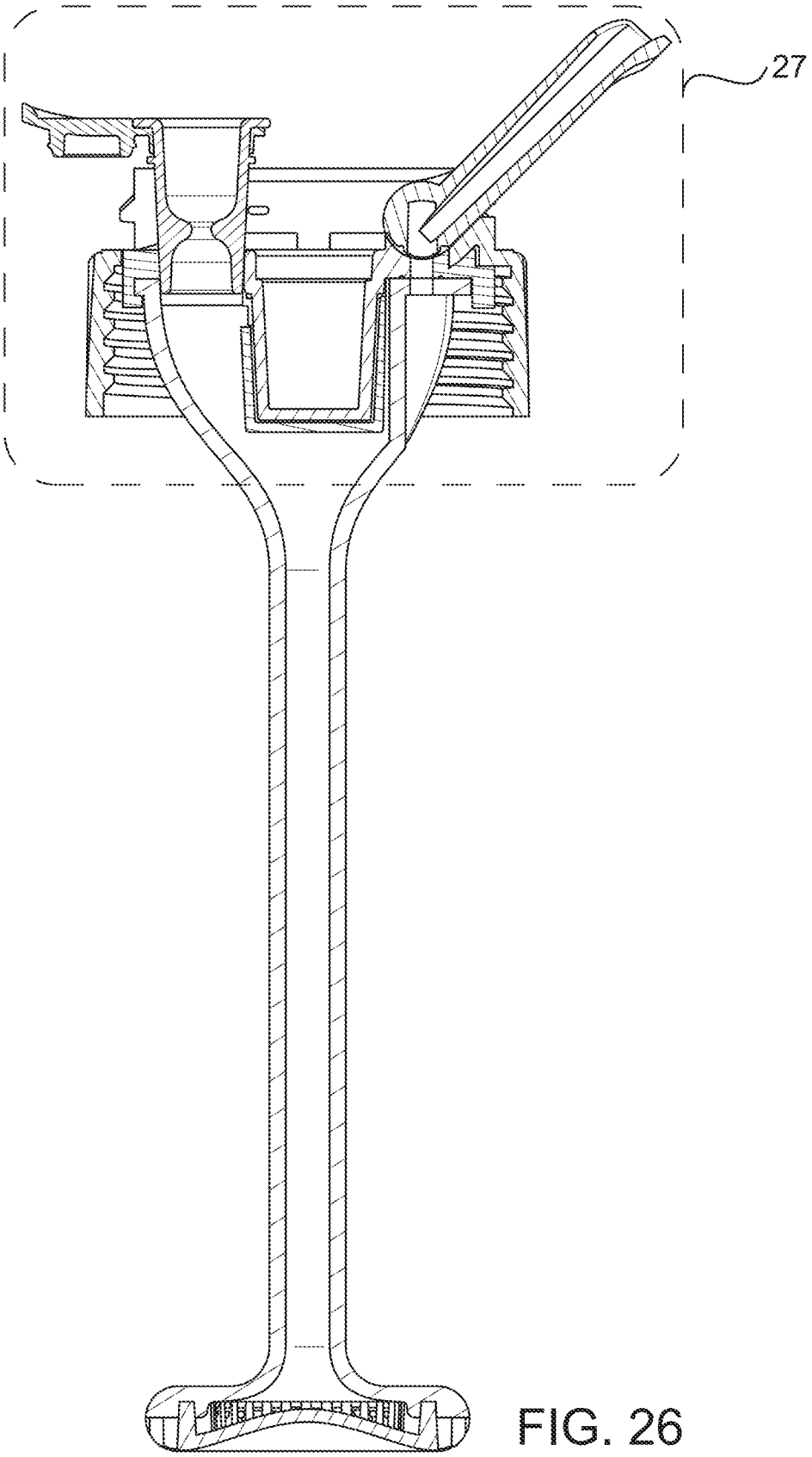
FIG. 26 is a cross-sectional view of the structure of FIG. 13.
Figure 27:
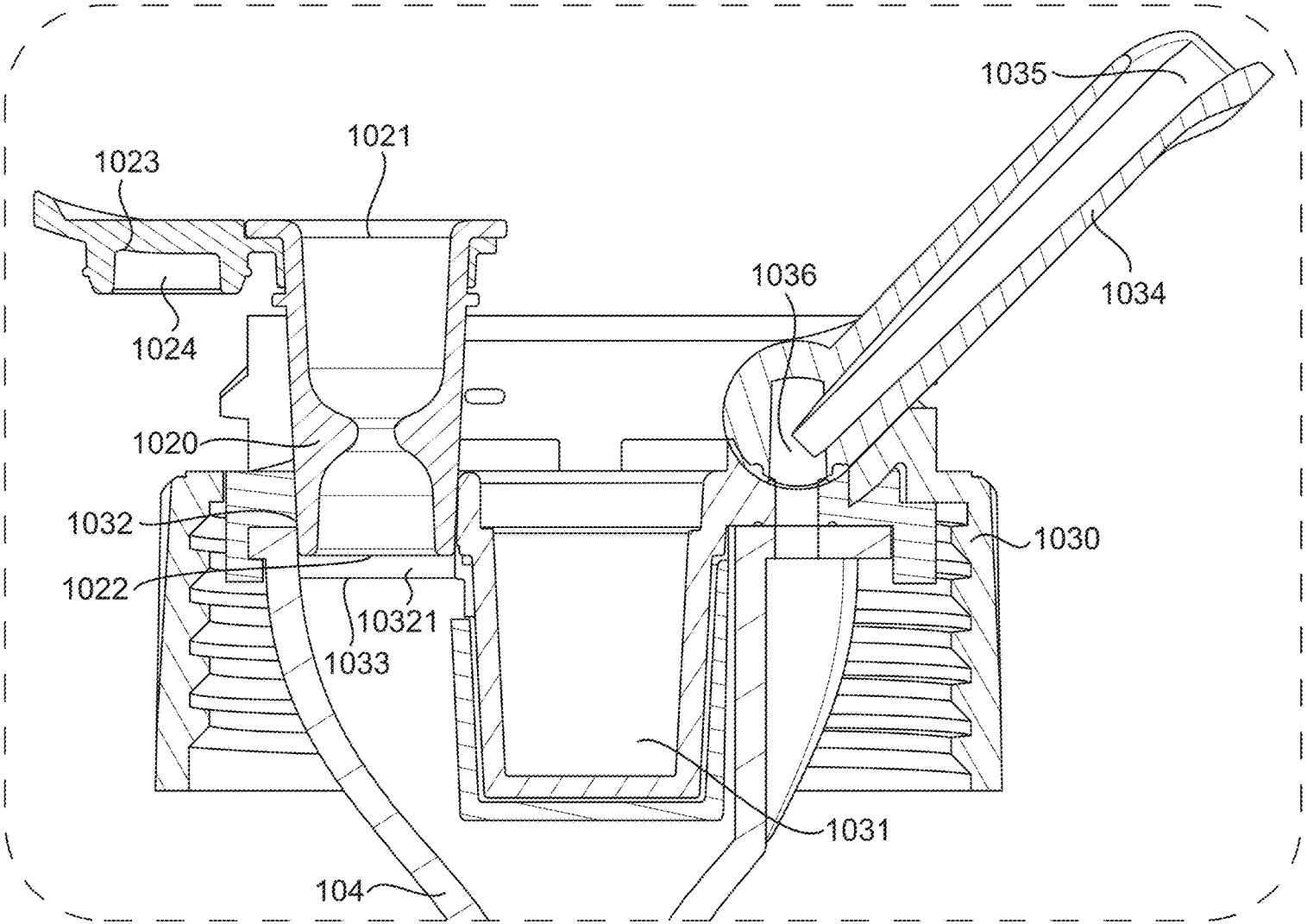
FIG. 27 is a cross-sectional view of the upper portion of the structure of FIG. 13.
Figure 28:
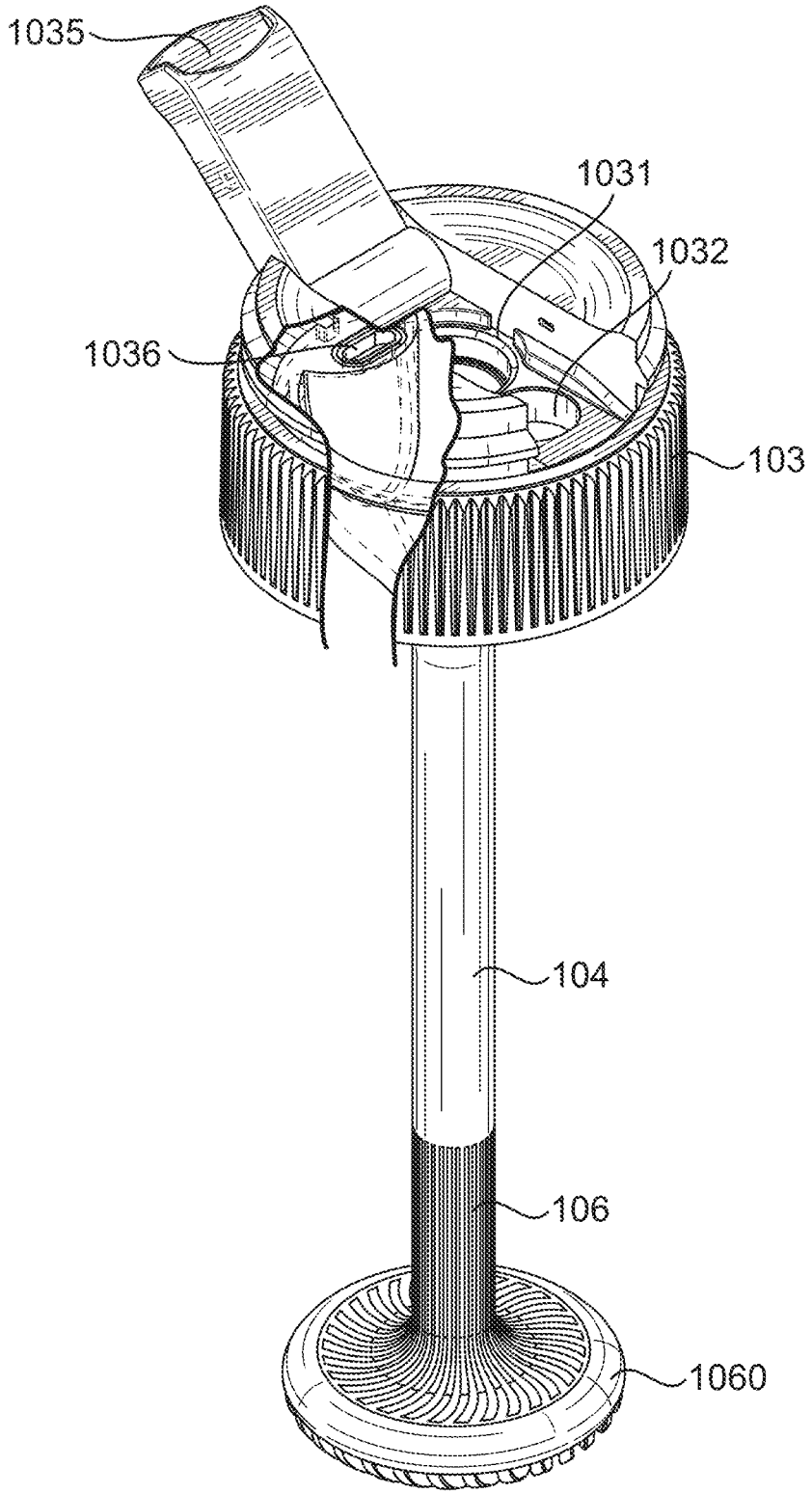
FIG. 28 is the perspective view of FIG. 12 showing part of the interior structure including the inlet.

Referring to FIGS. 26 and 27, an embodiment of the portable water pipe assembly 100 in open state is shown. The removable bowl 102 is positioned over the second bowl receiving region 1032 to provide a flow of the gas entrained with product from the apertures 1022 in the bowl body 1020 to the outlet 1033 during operation of the water pipe assembly; and the mouthpiece 1034 is in the open position that allows access to the compartment through an inlet 1036.

In an embodiment, the second bowl receiving region 1032 comprises a second recess configured to receive the bowl body 1020 when the mouthpiece 1034 is in the open state, the second recess comprising the outlet 1033 formed in a bottom region thereof. In some embodiments, the second bowl receiving region 1032 comprises a mount 10321 to receive and retain the bowl body 1020, the mount comprising the outlet 1033 formed therein. In another embodiment, the second bowl receiving region 1032 comprises a second recess configured to receive the bowl body 1020, the second recess being shallower than the first recess of the first receiving region 1031, so as to provide access to the removable bowl 102 when the bowl body 1020 is received in the second bowl receiving region 1032.

Figure 40:
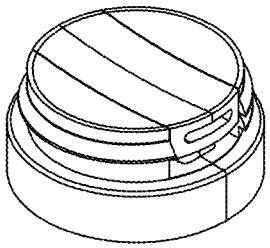
FIGS. 40-42 show different states of a representative "slidable" mouthpiece that can be used on a portable water pipe assembly of this disclosure.
Figure 41:
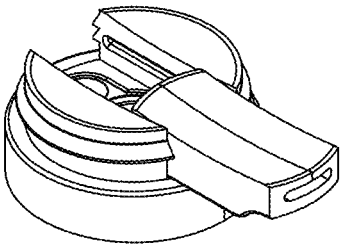
Figure 42:
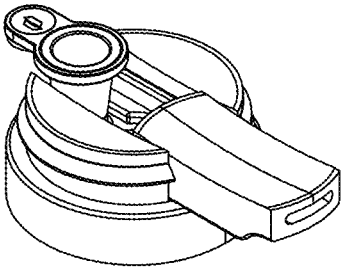

In an embodiment, the mouthpiece 1034 comprises an inhalation inlet 1036 configured to receive the flow of gas entrained with the product from the interior region of the container 101. In an embodiment, the mouthpiece 1034 is rotatably attached to the cap body 1030, and is configured to be rotated to transition between the closed position covering the compartment, and the open position that allows access to the compartment. In some embodiments, the mouthpiece 1034 is attached to the cap body 1030 via a hinge, and wherein rotating the mouthpiece at the hinge causes to mouthpiece to transition between the open and closed states. Alternatively, as shown in FIGS. 40-42, in an embodiment, the mouthpiece is slideably attached to the cap body, and is configured to be slid to transition between the closed position covering the compartment, and the open position that allows access to the compartment. In some embodiments, the upper cap piece 103 comprises tracks that engage the mouthpiece to allow the mouthpiece to slide between open and closed positions.

In an embodiment, the mouthpiece 1034 comprises the inhalation outlet 1035 and an inhalation inlet 1036 at either ends of a conduit formed in a straw portion, and wherein at least one of the inhalation inlet and inhalation outlet are sealed when the mouthpiece is in the closed position, so as to prevent passage of air and/or liquid therethrough. In another embodiment, the mouthpiece 1034 comprises the inhalation outlet 1035 and an inhalation inlet 1036 at either ends of a conduit formed in a rotatable or slidable straw portion, and wherein rotation or sliding of the straw portion of the mouthpiece to the closed position disengages the inhalation inlet from communication with the interior region of the container 101, so as to prevent passage of air and/or liquid into the mouthpiece conduit from the interior region of the container.

Figure 29:
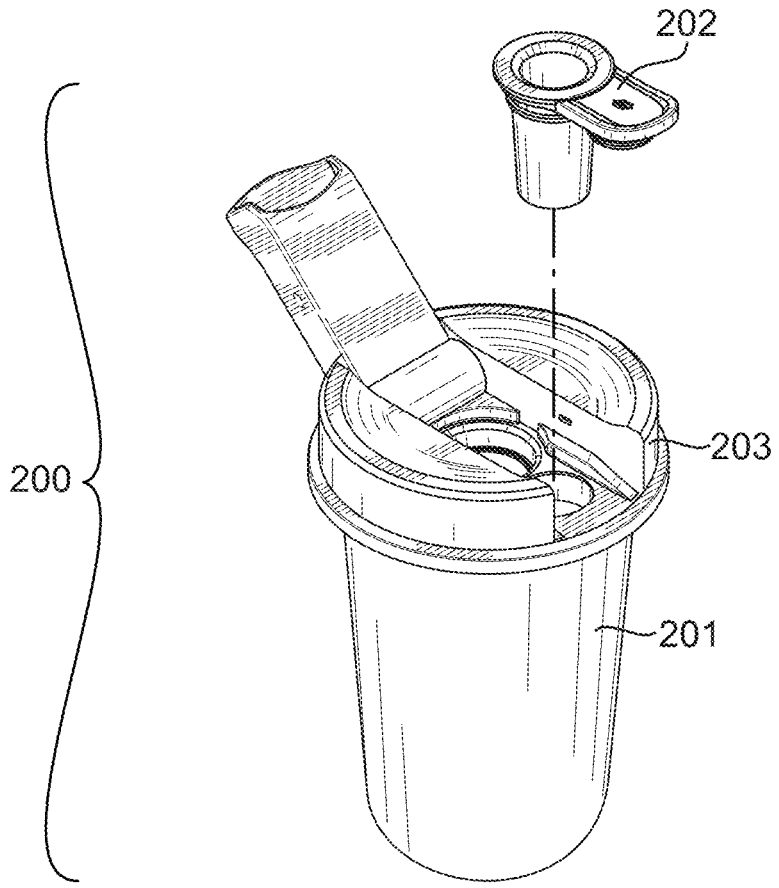
FIG. 29 is a perspective view of an embodiment of an alternative design.
Figure 30:
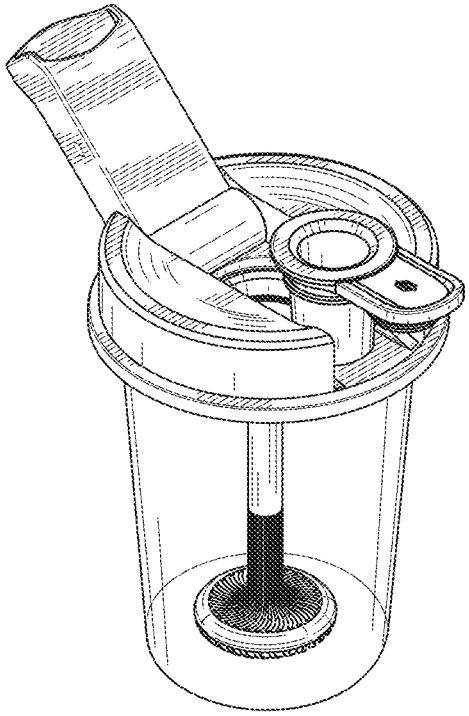
FIG. 30 is a perspective view of the embodiment of FIG. 29, in its open state.
Figure 31:
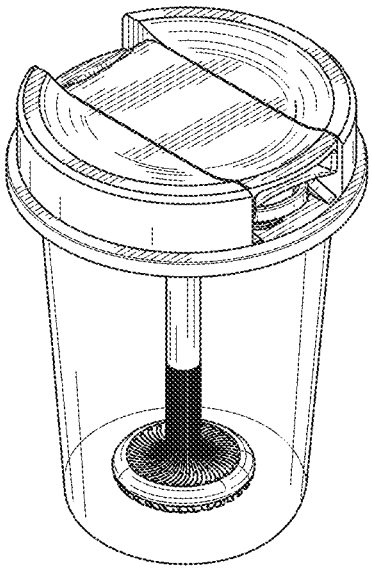
FIG. 31 is perspective view of the embodiment of FIG. 29, in its closed state.
Figure 32:
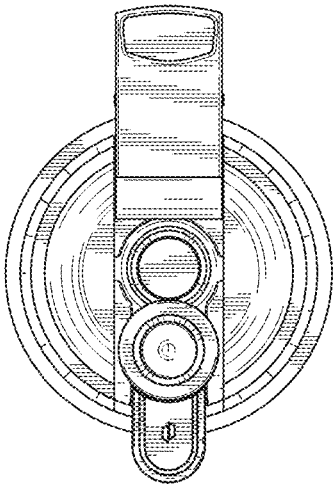
FIGS. 32-35 show various view of the embodiment of FIG. 29, in its open state.
Figure 33:
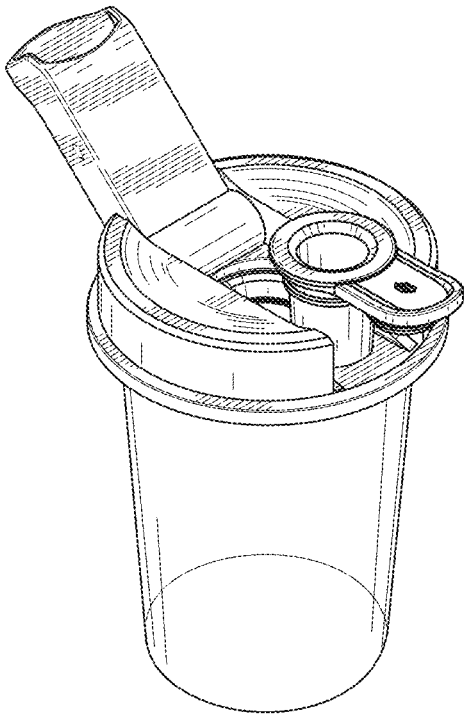
Figure 34:
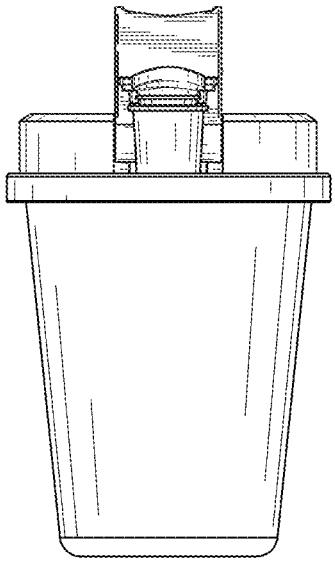
Figure 35:
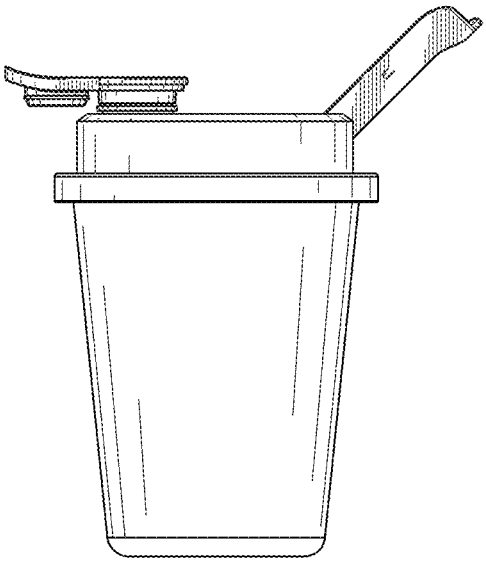
Figure 36:
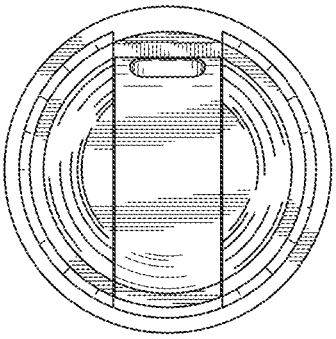
FIGS. 36-39 show various views of the embodiment of FIG. 29, in its closed state.
Figure 37:
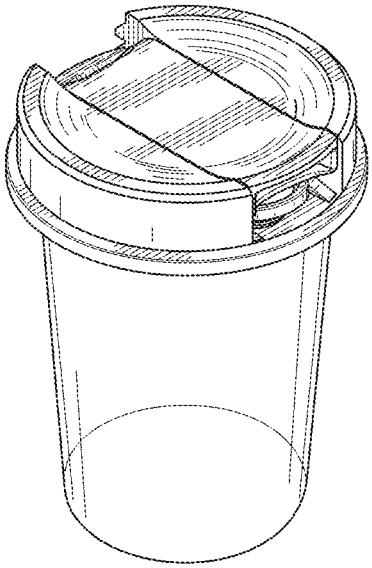
Figure 38:
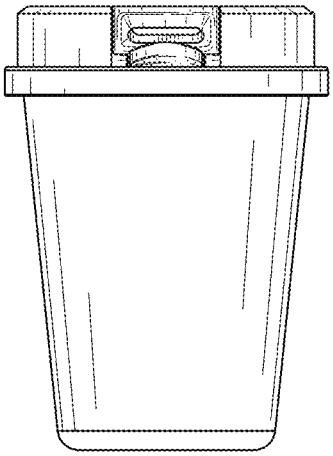
Figure 39:
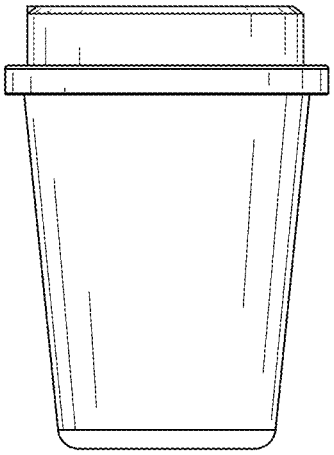

Although the water pipe assembly as shown in FIG. 1 has the appearance of a water bottle, other equivalent designs are also encompassed in the present disclosure. For example, in FIG. 29, a cup-like assembly 200 is shown in its open state. It comprises a cup body 201, an upper cap piece 203, and a removable bowl 202. The interior structure is shown in FIG. 30 (open state) and FIG. 31 (closed state), which is essentially the same as the water bottle version 100.

Figure 25A:
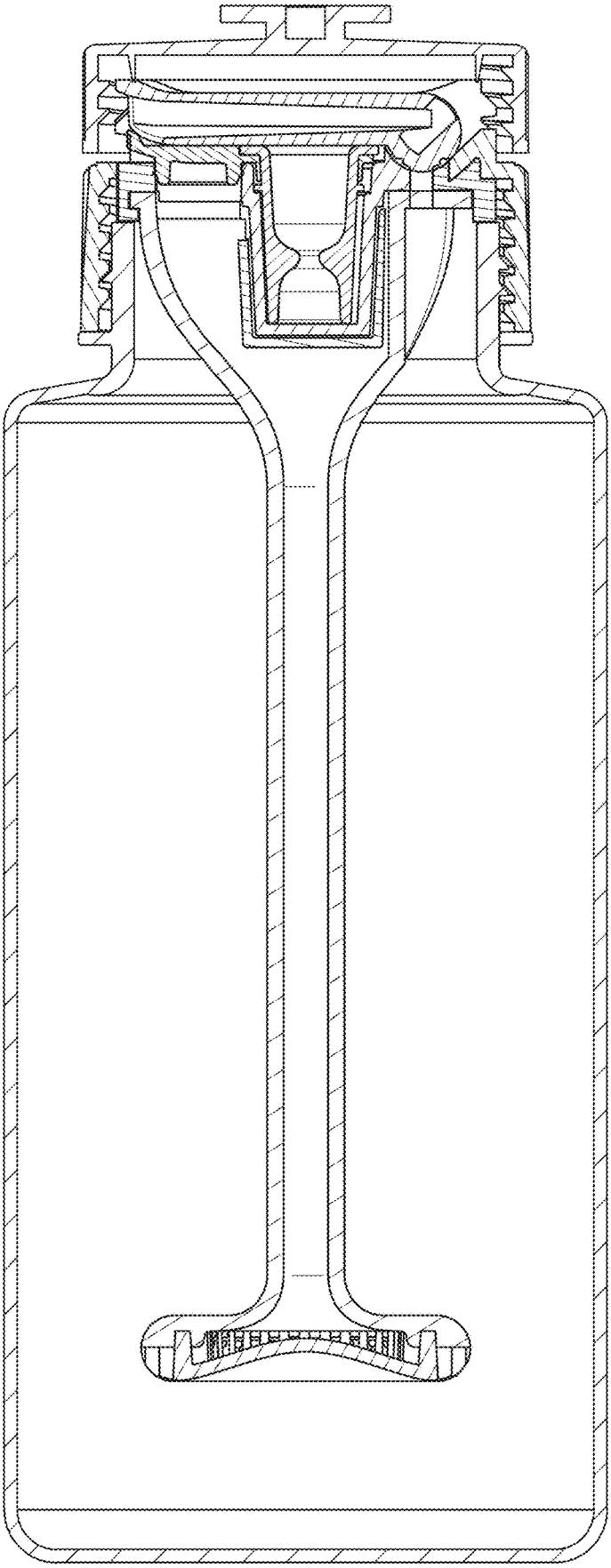
FIG. 25A is a cross-sectional view of an embodiment of the portable water pipe assembly in its closed state.
Figure 25B:
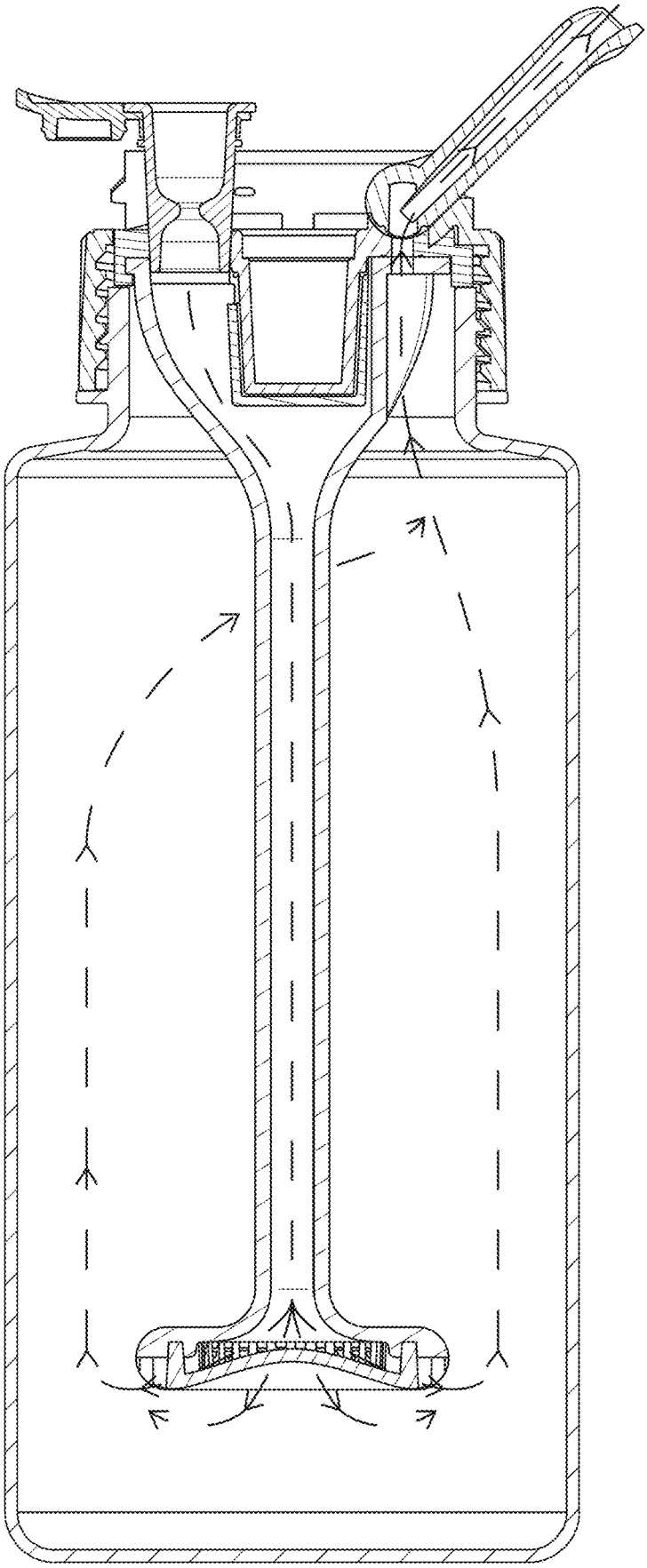
FIG. 25B is a cross-sectional view of an embodiment of the portable water pipe assembly in its open state, showing a representative gas flow path.

Referring to FIG. 25B, a representative gas flow path within the water pipe assembly during operation is illustrated in a cross-sectional view. The removable bowl 102 is filled with a product and sits in the recess of the second bowl receiving rejoin 1032. After the product is lit, the smoke produced therefrom passes through the one or more apertures 1022 in the bottom portion of the bowl body 1020 and the outlet 1033, and enters the gas flow tube 104. The gas entrained with the product travels down the tube 104 and diverges into a plurality of smaller airflows after passing through a bubbler assembly 106 attached to the end of the gas flow tube 104 and submerged in the water. Those small airflows generate bubbles, rise up to the water surface, and enter the upper portion of the container 101. The filtered gas enters the opened mouthpiece 1034 through an inlet 1036 that communicates between the interior of the container 101 and the mouthpiece 1034, and eventually inhaled by a user through an inhalation outlet 1035.

According to another aspect of the present disclosure, a method of using the portable electronic vaporizing device disclosed herein is provided. For example, the method may comprise: removing the upper cap piece from the container housing and filling the interior region of the container with water to a predetermined level; re-attaching the upper cap piece to the container housing, such that a lower end of the gas flow tube is submerged in the water in the interior region of the container; transitioning the mouthpiece to the open position to reveal the compartment having the first and second bowl receiving regions; inserting the removable bowl into the second bowl receiving region of the upper cap piece; filling the bowl body of the removable bowl with product; igniting the product in the bowl body, thereby forming the flow of gas entrained with the product that passes into the water in the interior region of the compartment and on to the mouthpiece; and inhaling the flow of gas entrained with the product received from the interior region of the compartment via the inhalation outlet of the mouthpiece.

In an embodiment, the method above further comprises: moving the removable bowl from the second bowl receiving region into the first recess of the first bowl receiving region, and positioning the handle of the removable bowl such that the sealing portion of the handle seals the outlet of the second receiving region; transitioning the mouthpiece to cover the first bowl receiving region having the bowl body therein; and optionally, covering the upper cap piece with the removable cap top. In another embodiment, the method disclosed herein further comprises removing the upper cap piece from the container housing, and removing the water contained in the interior region of the container.

EQUIVALENTS

While specific embodiments have been discussed, the above specification is illustrative, and not restrictive. Many variations will become apparent to those skilled in the art upon review of this specification. The full scope of the embodiments should be determined by reference to the claims, along with their full scope of equivalents, and the specification, along with such variations.

What is claimed is:

1. A pipe assembly for inhalation of a gas entrained with a product, comprising:

a container, the container having a housing about an interior region and comprising an upper opening;

a removable bowl for receiving the product, the removable bowl comprising a bowl body comprising a top opening and having one or more apertures in a bottom portion thereof to allow the gas entrained with the product to pass therethrough, and the removable bowl comprising a handle extending laterally from the bowl body and having a sealing portion;

an upper cap piece adapted to fit over the upper opening of the container housing, the upper cap piece comprising:

a cap body comprising a compartment having first and second bowl receiving regions, the first bowl receiving region comprising a first recess configured to receive the bowl body, and the second bowl receiving region comprising a receiving region outlet that passes through the cap body, and over which the removable bowl can be positioned to provide a flow of the gas entrained with the product from the one or more apertures in the bowl body to the receiving region outlet during operation of the pipe assembly; and a mouthpiece attached to the cap body, and having an inhalation outlet for inhaling the gas entrained with the product, the mouthpiece being configured to transition between a closed position covering the compartment, to an open position that allows access to the compartment, wherein the removable bowl is configured such that (i) the bowl body is received in the second bowl receiving region so as to provide the flow of the gas entrained with the product to the interior region of the container during operation of the pipe assembly, when the mouthpiece is in the open position, and (ii) the bowl body is received in the first recess of the first bowl receiving region and is covered by the mouthpiece when the mouthpiece is in the closed position, and wherein the removable bowl is configured such that the sealing portion of the handle extends over and seals off the receiving region outlet in the second bowl receiving region, when the bowl body is received in the first recess of the first bowl receiving region.

2. The pipe assembly of claim 1, wherein the upper cap piece comprises a threaded portion to attach to a complementary threaded portion at a top region of the container.

3. The pipe assembly of claim 1, wherein the sealing portion of the handle comprises a sealing projection that extends from an underside of the handle and is configured to be fitted over the receiving region outlet of the second bowl receiving region when the mouthpiece is in the closed position.

4. The pipe assembly of claim 1, wherein the second bowl receiving region comprises a second recess configured to receive the bowl body when the mouthpiece is in the open position, the second recess comprising the receiving region outlet formed in a bottom region thereof.

5. The pipe assembly of claim 1, wherein the second bowl receiving region comprises a mount to receive and retain the bowl body, the mount comprising the receiving region outlet formed therein.

6. The pipe assembly of claim 1, further comprising a removable cap top that is configured to be fitted over the cap body when the mouthpiece is in the closed position.

7. The pipe assembly of claim 1, wherein the mouthpiece substantially conceals the compartment having the first and second bowl receiving regions, when the mouthpiece is in the closed position.

8. The pipe assembly of claim 1, wherein the mouthpiece comprises an inhalation inlet configured to receive the flow of the gas entrained with the product from the interior region of the container.

9. The pipe assembly of claim 1, wherein the mouthpiece is rotatably attached to the cap body, and is configured to be rotated to transition between the closed position covering the compartment, and the open position that allows access to the compartment.

10. The pipe assembly of claim 1, wherein the mouthpiece is attached to the cap body via a hinge, and wherein rotating the mouthpiece at the hinge causes to mouthpiece to transition between the open and closed positions.

11. The pipe assembly of claim 1, wherein the mouthpiece is slideably attached to the cap body, and is configured to be slid to transition between the closed position covering the compartment, and the open position that allows access to the compartment.

12. The pipe assembly of claim 11, wherein the upper cap piece comprises tracks that engage the mouthpiece to allow the mouthpiece to slide between open and closed positions.

13. The pipe assembly of claim 1, wherein the mouthpiece comprises the inhalation outlet and an inhalation inlet at either ends of a conduit formed in a straw portion, and wherein at least one of the inhalation inlet and inhalation outlet are sealed when the mouthpiece is in the closed position, so as to prevent passage of air and/or liquid therethrough.

14. The pipe assembly of claim 1, wherein the mouthpiece comprises the inhalation outlet and an inhalation inlet at either ends of a conduit formed in a rotatable or slidable straw portion, and wherein rotation or sliding of the straw portion of the mouthpiece to the closed position disengages the inhalation inlet from communication with the interior region of the container, so as to prevent passage of air and/or liquid into the mouthpiece conduit from the interior region of the container.

15. The pipe assembly of claim 1, wherein the first and second bowl receiving regions are located adjacent to one another in the compartment, such that the sealing portion of the handle is capable of extending over and sealing off the receiving region outlet in the second bowl receiving region when the bowl body is received in the first receiving region.

16. The pipe assembly of claim 1, wherein the first recess of the first bowl receiving region is configured to accommodate a major portion of the bowl body within the first recess when the bowl body is received in the first bowl receiving region, and the first recess is configured to allow the handle of the removable bowl to extend laterally from a top of the first recess and over the receiving region outlet of the second receiving region to seal the receiving region outlet.

17. The pipe assembly of claim 1, wherein the second bowl receiving region comprises a second recess that is adjacent to the first recess of the first bowl receiving region, the second recess being separated from the first recess by a distance substantially equivalent to a reach of the handle from the first receiving region to the receiving region outlet of the second receiving region, when the bowl body is received in the first receiving region.

18. The pipe assembly of claim 1, wherein the second bowl receiving region comprises a second recess configured to receive the bowl body, the second recess being shallower than the first recess of the first receiving region, so as to provide access to the removable bowl when the bowl body is received in the second bowl receiving region.

19. The pipe assembly of claim 1, wherein the second bowl receiving region comprises a second recess having the receiving region outlet therein and configured to receive the bowl body, and wherein the sealing portion of the handle of the removable bowl extends into the second recess to plug the second recess and the receiving region outlet therein.

20. The pipe assembly of claim 1, wherein the container is transparent or translucent and made of food-grade material.

21. The pipe assembly of claim 20, wherein the food-grade material is BPA free.

22. The pipe assembly of claim 1, wherein the bowl body of the removable bowl is made of ceramic and the handle comprises a silicone sealing material.

23. The pipe assembly of claim 1, wherein the one or more apertures in the bottom portion of the bowl body are sized to allow air flow thereinthrough while also substantially maintaining the product contained in the bowl body.

24. The pipe assembly of claim 1, wherein the product is selected from tobacco leaves, *cannabis* flowers, or other herbal substances.

25. A method of using the pipe assembly according to claim 1, comprising:

transitioning the mouthpiece to the open position to reveal the compartment having the first and second bowl receiving regions;

inserting the removable bowl into the second bowl receiving region of the upper cap piece;

filling the bowl body of the removable bowl with the product;

igniting the product in the bowl body, thereby forming the flow of the gas entrained with the product that passes into the interior region of the compartment and on to the mouthpiece; and inhaling the flow of the gas entrained with the product received from the interior region of the compartment via the inhalation outlet of the mouthpiece.

26. The method according to claim 25, further comprising:

moving the removable bowl from the second bowl receiving region into the first recess of the first bowl receiving region, and positioning the handle of the removable bowl such that the sealing portion of the handle seals the receiving region outlet of the second receiving region;

transitioning the mouthpiece to cover the first bowl receiving region having the bowl body therein; and optionally, covering the upper cap piece with a removable cap top.

* * * * *